US007418231B2

(12) United States Patent
Ueno et al.

(10) Patent No.: US 7,418,231 B2
(45) Date of Patent: Aug. 26, 2008

(54) CLEANING BLADE MEMBER

(75) Inventors: Miyuki Ueno, Yokohama (JP); Shuji Abe, Yokohama (JP)

(73) Assignee: Synztec Co., Ltd., Tokyo (JP)

( * ) Notice: Subject to any disclaimer, the term of this patent is extended or adjusted under 35 U.S.C. 154(b) by 0 days.

(21) Appl. No.: 11/639,240

(22) Filed: Dec. 15, 2006

(65) Prior Publication Data

US 2007/0140762 A1 Jun. 21, 2007

(30) Foreign Application Priority Data

Dec. 19, 2005 (JP) ..... 2005-365559
Dec. 7, 2006 (JP) ..... 2006-331111

(51) Int. Cl.
*G03G 21/00* (2006.01)

(52) U.S. Cl. ..... 399/350; 399/343; 399/351

(58) Field of Classification Search ..... 399/345, 399/350, 343; 162/281; 428/322.2; 15/256.5
See application file for complete search history.

(56) References Cited

U.S. PATENT DOCUMENTS 6,456,820 B1 * 9/2002 Sato et al. ..... 399/350
6,473,589 B2 * 10/2002 Hisakuni ..... 399/350

FOREIGN PATENT DOCUMENTS

JP 2542204 B2 7/1996
JP 2002-214989 A 7/2002
JP 2002-214990 A 7/2002

* cited by examiner

*Primary Examiner*—Marvin Lateef
*Assistant Examiner*—G. M. Hyder
(74) *Attorney, Agent, or Firm*—Sughrue Mion, PLLC

(57) ABSTRACT

A cleaning blade member for use in a cleaning section for removing toner on a toner-deposited body, the cleaning blade member comprising: an edge layer contacting the toner-deposited body; and a back layer provided on a back side of the edge layer, and wherein the edge layer has a Young's modulus of 8 to 20 MPa and an impact resilience at 25° C. of 20 to 40%, and when the Young's modulus of the edge layer is designated as $E_a$, a Young's modulus of the back layer is designated as $E_b$, a thickness of the edge layer is designated as $T_a$, and a thickness of the back layer is designated as $T_b$, a ratio ($R_b/R_a$) between a contribution rate $R_a$ of the Young's modulus of the edge layer represented by the following equation (1), and a contribution rate $R_b$ of the Young's modulus of the back layer represented by the following equation (2) is 0.01 to 6.0, and a total Young's modulus ($R_a+R_b$) of the edge layer and the back layer is 7 to 14 MPa:

$$R_a=[T_aE_a/(T_a+T_b)] \quad (1)$$

$$R_b=[T_bE_b/(T_a+T_b)]. \quad (2)$$

5 Claims, 2 Drawing Sheets

CLEANING BLADE MEMBER

The entire disclosure of Japanese Patent Applications Nos. 2005-365559 filed Dec. 19, 2005 and 2006-331111 filed Dec. 7, 2006 is expressly incorporated by reference herein.

BACKGROUND OF THE INVENTION

1. Field of the Invention

This invention relates to a cleaning blade member, and more particularly, to a cleaning blade member for removing a toner on a toner image bearing body, on which a toner image is formed and from which the toner image is transferred onto a material for receiving the toner image, such as a photoconductor or a transfer belt in electrophotography.

2. Description of the Related Art

With the electrophotographic process, a cleaning blade for removing a toner is generally used to use an electrophotographic photoconductor or a transfer belt repeatedly. Since the cleaning blade makes contact with the photoconductor for a long term, it is required to have satisfactory wear resistance and a low coefficient of friction. In recent years, as the life of the unit lengthens, the photoconductor has become a product with high durability, and the cleaning blade has also been required to have high durability.

To impart high durability to the blade, it is necessary for the blade to have a high degree of hardness. However, a high degree of hardness of the cleaning blade of a single-layer structure leads to too high a pressure of contact with the photoconductor, posing the problem that a film on the surface of the photoconductor peels off, or the edge of the blade droops. That is, when the blade is supported horizontally in a cantilevered manner at an end portion thereof on the side opposite to its side in contact with the photoconductor, the height of the leading end of the blade decreases. Thus, proposals have been made for cleaning blades each having a plural-layer structure (see, for example, Japanese Patent No. 2542204, Japanese Unexamined Patent Publication No. 2002-214989, and Japanese Unexamined Patent Publication No. 2002-214990).

Since these cleaning blades use plural types of materials, a layer in contact with the photoconductor, and other layers make up for each other's characteristics, thereby showing excellent characteristics as a whole. However, they exhibit satisfactory characteristics in either a high temperature environment or a low temperature environment, and do not show satisfactory characteristics in an environment at high temperatures to low temperatures.

Hence, there has been an intense demand for a cleaning blade which maintains sufficiently stable mechanical characteristics even if a temperature environment changes in a range involving high temperatures to low temperatures.

The present invention has been accomplished in the light of the above-mentioned circumstances. It is an object of the present invention to provide a high durability cleaning blade member having excellent mechanical characteristics, such as wear resistance and resistance to edge drooping (edge drooping resistance), in any environment.

SUMMARY OF THE INVENTION

A first aspect of the present invention, for attaining the above object, is a cleaning blade member for use in a cleaning section for removing toner on a toner-deposited body, the cleaning blade member comprising two layers consisting of:

an edge layer making contact with the toner-deposited body; and a back layer provided on a back side of the edge layer, and wherein the edge layer has a Young's modulus of 8 to 20 MPa and an impact resilience at 25° C. of 20 to 40%, and when the Young's modulus of the edge layer is designated as $E_a$, a Young's modulus of the back layer is designated as $E_b$, a thickness of the edge layer is designated as $T_a$, and a thickness of the back layer is designated as $T_b$, a ratio ($R_b/R_a$) between a contribution rate $R_a$ of the Young's modulus of the edge layer represented by an equation (1) indicated below, and a contribution rate $R_b$ of the Young's modulus of the back layer represented by an equation (2) indicated below is 0.01 to 6.0, and a total Young's modulus ($R_a+R_b$) of the edge layer and the back layer is 7 to 14 MPa:

$$R_a=[T_aE_a/(T_a+T_b)] \quad (1)$$

$$R_b=[T_bE_b/(T_a+T_b)] \quad (2)$$

A second aspect of the present invention is the cleaning blade member according to the first aspect, wherein a peak temperature at tan δ (1 Hz) of the edge layer is −20° C. to 5° C.

A third aspect of the present invention is the cleaning blade member according to the first or second aspect, wherein a difference ΔHs (°) (JIS A) between a hardness at 50° C. of the edge layer, $HS_{T50}$ (°) (JIS A), and a hardness at 10° C. of the edge layer, $HS_{T10}$ (°) (JIS A), is 4 or less.

A fourth aspect of the present invention is the cleaning blade member according to any one of the first to third aspects, wherein a difference ΔRb (%) between an impact resilience at 50° C. of the edge layer, $Rb_{T50}$ (%), and an impact resilience at 10° C. of the edge layer, $Rb_{T10}$ (%), is 30 or less.

A fifth aspect of the present invention is the cleaning blade member according to any one of the first to fourth aspects, wherein the edge layer and the back layer are integrally molded by centrifugal molding.

According to the present invention, a high durability cleaning blade member is provided which has excellent mechanical characteristics, such as wear resistance and edge drooping resistance, in any environment.

BRIEF DESCRIPTION OF THE DRAWINGS

For a more complete understanding of the present invention and the advantages thereof, reference is now made to the following descriptions in conjunction with the accompanying drawings.

DESCRIPTION OF THE PREFERRED EMBODIMENTS

Figure 1:
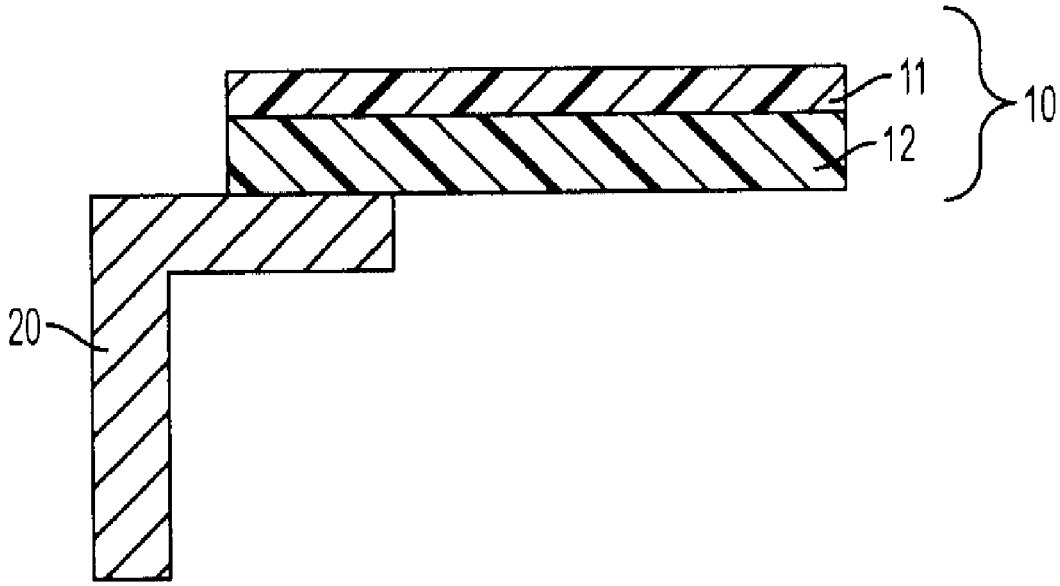
FIG. 1 is a side view of a cleaning blade according to an embodiment of the present invention.

The present invention has been made based on the discovery that the mechanical characteristics of a cleaning blade member can be controlled by defining Young's modulus and impact resilience.

That is, the cleaning blade member of the present invention comprises two layers, i.e., an edge layer making contact with a toner-deposited body, and a back layer provided on the back side of the edge layer. The cleaning blade member is rendered excellent in wear resistance and edge drooping resistance, and highly durable, by defining the Young's modulus and impact resilience of the edge layer, the ratio between the contribution rates of the Young's moduli of the edge layer and the back layer, and the Young's modulus of the cleaning blade member.

The edge layer according to the present invention is the layer on the side contacting the toner-deposited body, and has Young's modulus of 8 to 20 MPa and impact resilience at 25° C. of 20 to 40%. By defining the Young's modulus and impact resilience of the edge layer in these ranges, a high durability cleaning blade member having excellent wear resistance is provided. When the Young's modulus is defined in this range, the edge layer has a relatively high degree of hardness, thus making it possible to decrease the area of contact with the toner-deposited body, and decrease the coefficient of friction. If the Young's modulus is greater than this range, wear is liable to occur. A smaller Young's modulus than this range fails to obtain a sufficient hardness. By defining the impact resilience of the edge layer in the above range, cleaning characteristics can be maintained at a satisfactory level. If the impact resilience is higher than this range, wear is apt to occur. A lower impact resilience than this range results in a tendency toward chipping.

The cleaning blade member of the present invention has the back layer provided on the back side of the edge layer in order to compensate for the characteristics of the edge layer fulfilling the above-mentioned definitions. That is, the cleaning blade member is of a two-layer structure, meaning that there can be realized a cleaning blade member which is free from edge drooping and causes no peeling of the film on the surface of the photoconductor, even when a high degree of hardness is imparted to the edge layer making contact with the toner.

The cleaning blade member of the present invention concretely has the feature that when the Young's modulus of the edge layer is designated as $E_a$, the Young's modulus of the back layer is designated as $E_b$, the thickness of the edge layer is designated as $T_a$, and the thickness of the back layer is designated as $T_b$, the ratio ($R_b/R_a$) between the contribution rate $R_a$ of the Young's modulus of the edge layer represented by the following equation (1), and the contribution rate $R_b$ of the Young's modulus of the back layer represented by the following equation (2) is 0.01 to 6.0, and the total Young's modulus ($R_a+R_b$) of the edge layer and the back layer is 7 to 14 MPa:

$$R_a=[T_aE_a/(T_a+T_b)] \quad (1)$$

$$R_b=[T_bE_b/(T_a+T_b)] \quad (2)$$

The contribution rate of the Young's modulus, as described above, refers to the proportion of the thickness of the edge layer or the back layer in the entire cleaning blade multiplied by the Young's modulus, and serves as an indicator of the influence of the Young's modulus of each layer in the entire cleaning blade. That is, when the ratio ($R_b/R_a$) between the contribution rate $R_a$ of the Young's modulus of the edge layer and the contribution rate $R_b$ of the Young's modulus of the back layer is 1, the influence of the edge layer and the influence of the back layer in the entire cleaning blade are comparable. When this ratio is less than 1, the influence of the edge layer in the entire cleaning blade is greater. When this ratio is more than 1, the influence of the back layer in the entire cleaning blade is greater.

The reason why the ratio ($R_b/R_a$) between the contribution rate of the Young's modulus of the edge layer and that of the Young's modulus of the back layer is 0.01 to 6.0 is that if this ratio is lower than this range, the effect produced by the provision of the back layer does not become remarkable; if the ratio is higher than this range, on the other hand, the influence of the back layer is so great that the characteristics of the edge layer are not exhibited.

The Young's modulus of a cleaning blade member can also be determined by making measurements on the two layers as a whole. In the present invention, however, ($R_a+R_b$), which is the sum of the contribution rate $R_a$ of the Young's modulus and the contribution rate $R_b$ of the Young's modulus, is taken as the Young's modulus of the cleaning blade member. The Young's modulus ($R_a+R_b$) of the cleaning blade member of the present invention is 7 to 14 MPa. If its value is higher than this range, the photoconductor is likely to be damaged. If this value is lower than this range, the cleaning blade member is likely to wear.

The fulfillment of the above-described definitions realizes a high durability cleaning blade member excellent in mechanical characteristics, such as wear resistance and edge drooping resistance, in any environment.

The edge layer preferably has a peak temperature at tan δ (1 Hz) of −20° C. to 5° C., because this feature achieves a cleaning blade member which can maintain rubbery nature even in a low-temperature low-humidity environment and minimally undergoes chipping.

If the peak temperature is higher than this range, the resulting cleaning blade member loses rubbery nature in a low-temperature low-humidity environment, is very susceptible to chipping, and shows great changes according to the environment. The peak temperature lower than −20° C. generally results in low strength, and poor wear resistance.

With the edge layer, the difference ΔHs (°) (JIS A) between the hardness at 50° C., $Hs_{T50}$ (°) (JIS A), and the hardness at 10° C., $HS_{T10}$ (°) (JIS A), is preferably 4 or less. Also, the edge layer of the present invention preferably has rubber hardness of 70 to 90° according to JIS A. By fulfilling these conditions, the resulting cleaning blade member has hardness minimally temperature-dependent, and is fully stable even in a changing environment.

With the edge layer, moreover, the difference ΔRb (%) between the impact resilience at 50° C., $Rb_{T50}$ (%), and the impact resilience at 10° C., $Rb_{T10}$ (%), is preferably 30 or less. By fulfilling this condition, the resulting cleaning blade member has impact resilience minimally temperature-dependent, and is fully stable even in a changing environment.

The 100% permanent elongation of the cleaning blade member is preferably 4% or less. If this parameter is larger than 4%, the drooping of the edge portion is marked during use of the cleaning blade member, thus resulting in a lowered linear pressure and deteriorated cleaning performance.

The tensile strength at 300% elongation (300% modulus) of the cleaning blade member is preferably 10 MPa or more. If it is less than 10 MPa, wear resistance tends to decline, increasing a tendency toward chipping of the edge after passage of a small number of sheets, or a tendency toward occurrence of an image defect such as a white patch.

The tensile strength at 25° C. of the cleaning blade member is preferably 15 MPa or higher. This parameter lower than 15 MPa is not preferred, because it lowers wear resistance.

The tear strength of the cleaning blade member is preferably 40 kN/m or higher. A high tear strength of 40 kN/m or above leads to the formation of a cleaning blade member having excellent wear resistance.

The edge layer and the back layer of the cleaning blade member according to the present invention each comprise polyurethane, and can be produced by reacting polyol, polyisocyanate and a crosslinking agent.

Examples of the polyol are polyester polyols obtained by dehydration condensation of diols and dibasic acids, polycarbonate polyols obtained by the reaction of diols and alkyl carbonates, caprolactone-based polyols, and polyether polyols. The proportion of the polyol blended is preferably 60 to 80% by mass in the polyurethane.

The polyisocyanate reacted with the polyol is preferably one whose molecular structure is relatively not rigid. Examples of such polyisocyanate are 4,4'-diphenylmethane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI). A particularly preferred example is MDI. The proportion of the polyisocyanate incorporated is preferably 30 to 80 parts by mass per 100 parts by mass of the polyurethane. If this proportion is less than 30 parts by mass, tensile strength may be insufficient. If the proportion is more than 80 parts by mass, on the other hand, permanent elongation will be too great.

The crosslinking agent is, for example, a diol (bifunctional), a triol (trifunctional), or a diamino compound (bifunctional). Of course, these compounds may be used in combination.

The diol is not limited, and its examples include propanediol (PD) and butanediol (BD).

Nor is the triol limited, but a triol having a molecular weight of 120 to 2500 is preferred, and a triol having a molecular weight of 120 to 1000 is more preferred. Concrete examples are short-chain triols such as trimethylolethane (TME) and trimethylolpropane (TMP), and caprolactone-based triols (triols synthesized from ϵ-caprolactone) represented by the equation (3) below which have larger molecular weights than those of the short-chain triols. The triol is added to improve characteristics, such as creep or stress relaxation.

(3)

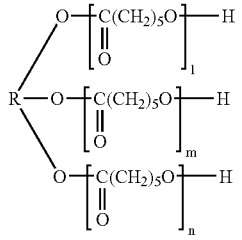

where R represents an alkyl group.

The diamino compound is not limited, but its melting point is preferably 80° C. or lower. The reason is that when reacted, the diamino compound needs to be heated to a temperature of the melting point or higher, and if its temperature is 80° C. or higher, an extremely short pot life will result. If the pot life becomes short, molding cannot be performed, or dimensional accuracy deteriorates. The term "pot life" refers to a period during which viscosity is relatively low and fluidity is kept.

Unlike 2,2',3,3'-tetrachloro-4,4'-diaminodiphenylmethane, the diamino compound is preferably a compound having no chlorine in its molecular structure, but having an aromatic ring. Moreover, the diamino compound is preferably slow in reaction rate, as compared with a case where 2,2',3,3'-tetrachloro-4,4'-diaminodiphenylmethane is used under the same curing and molding conditions. Such a diamino compound is practically free from steric hindrance, because it contains no chlorine atoms. Since the diamino compound contains the aromatic ring, the polyurethane cured using it has excellent mechanical strength. If the diamino compound is higher in reaction rate than 2,2',3,3'-tetrachloro-4,4'-diaminodiphenylmethane, no sheet can be shaped because of too rapid a reaction.

The diamino compound is available in a liquid type or a solid type, but the liquid type is preferred. As the diamino compound, those of a diaminodiphenylmethane series or those of a phenylenediamine series are named. Concrete examples are 4,4'-methylenedianiline (DDM), 3,5-dimethylthio-2,4-toluenediamine (DMTDA), 2,4-toluenediamine (2,4-TDA), 2,6-toluenediamine (2,6-TDA), methylenebis(2-ethyl-6-methylamine), 1,4-di-sec-butylaminobenzene, 4,4-di-sec-butylaminodiphenylmethane, 1,4-bis(2-aminophenyl) thiomethane, diethyltoluenediamine, trimethylenebis(4-aminobenzoate), and polytetramethylene oxide di-p-aminobenzoate.

The proportion of any of these crosslinking agents incorporated is not limited, but the molar ratio of the trifunctional crosslinking agent in the crosslinking agents is preferably 0 to 0.60, more preferably 0.05 to 0.40. Two or more of the bifunctional crosslinking agents and the trifunctional crosslinking agents may each be mixed.

The α-value is preferably 0.7 to 1.0. The α-value is a value represented by the equation shown below. If the α-value is larger than 1.0, the functional groups of the crosslinking agent, which are hydroxyl groups or diamino groups, are left. Thus, the photoconductor or the like, which contacts the cleaning blade, may be stained. If the α-value is less than 0.7, the crosslinking density is so low that strength may be insufficient, or deactivation of the remaining isocyanate may take time, thereby staining the photoconductor.

$$\alpha - \text{value} = \frac{\text{Number of moles of functional groups of crosslinking agent}}{\text{Number of moles of isocyanate groups remaining after reaction of polyol, crosslinking agent and isocyanate}}$$

A polyisocyanate is incorporated into the above polyol and crosslinking agent, and their reaction is performed, with the parts by mass of the isocyanates, the parts by mass and proportion of the crosslinking agent, etc. being adjusted, whereby polyurethane composed of the edge layer and the back layer fulfilling the aforementioned definitions can be produced. Preferably, the hardness of the edge layer is rendered 70 to 90° according to JIS A, and the hardness of the back layer is rendered 60 to 80° according to JIS A. By imparting a high degree of hardness to the edge layer making contact with the toner-deposited body, and imparting a lower hardness, than that of the edge layer, to the back layer provided on the back side of the edge layer, a cleaning blade member having high durability and excellent in wear resistance and edge drooping resistance is obtained.

A common manufacturing method for polyurethane, such as the prepolymer process or the one-shot process, can be used in preparing the cleaning blade member of the present invention. Preferably, this cleaning blade member is molded by the centrifugal molding method.

In producing the cleaning blade member by the centrifugal molding method, while a rotating drum of a centrifugal molding machine is being rotated at a predetermined rotational speed, molding materials for the edge layer and the back layer are sequentially charged into it, and molded. For example, the material for the back layer is first charged into the drum to mold the back layer, and then the material for the edge layer is charged to mold the edge layer on the back layer. At this time, it is preferred that before the layer to be molded first is completely cured, the material for the layer to be molded subsequently be charged. By so doing, the two layers can be molded integrally. Moreover, the air surface, namely, the surface of the layer to be molded subsequently becomes flatter than the surface of the mold. Thus, it is desirable to use the resulting cleaning blade such that the air surface side contacts the electrostatically charged body.

However, the method of shaping the cleaning blade member of the present invention is not limited to the above-described method. Examples of the shaping method are a method which comprises molding the back layer by casting, pouring or the like, and separately molding the edge layer by casting; and methods comprising molding the edge layer on the back layer by dipping or spraying.

The thus produced polyurethane is formed into a cleaning blade member of predetermined dimensions by cut-off or the like, and is adhered to a support member with the use of an adhesive or the like to produce a cleaning blade.

FIG. 1 shows a side view of a cleaning blade according to an embodiment of the present invention. As illustrated, a cleaning blade member 10 composed of an edge layer 11 and a back layer 12 is adhered to a support member 20.

The present invention will be described based on the blade produced using polyurethanes (a) to (g) shown below, but this invention is not limited to them.

Polyurethane (a):

100 Parts by mass of 1,9-ND adipate having a molecular weight of 2,000, which had been obtained from 1,9-nonanediol and adipic acid, 50 parts by mass of 4,4'-diphenylmethane diisocyanate (MDI), and propanediol (PD)/trimethylolethane (TME)/3,5-dimethylthio-2,4-toluenediamine (DMTDA) as a crosslinking agent were blended, the amount of the crosslinking agent being such that an α-value was 0.95, the molar ratio of the diamino compound in the bifunctional crosslinking agent was 0.10, and the molar ratio of the trifunctional crosslinking agent in the crosslinking agent was 0.05. These materials were reacted to form polyurethane (a).

Polyurethane (b):

100 Parts by mass of polytetramethylene glycol (PTG) having a molecular weight of 1600, 60 parts by mass of 4,4'-diphenylmethane diisocyanate (MDI), and butanediol (BD)/trimethylolpropane (TMP)/3,5-dimethylthio-2,4-toluenediamine (DMTDA) as a crosslinking agent were blended, the amount of the crosslinking agent being such that an α-value was 0.95, the molar ratio of the diamino compound in the bifunctional crosslinking agent was 0.02, and the molar ratio of the trifunctional crosslinking agent in the crosslinking agent was 0.10. These materials were reacted to form polyurethane (b)

Polyurethane (c):

100 Parts by mass of 1,9-ND adipate having a molecular weight of 2,000, which had been obtained from 1,9-nonanediol and adipic acid, 40 parts by mass of 4,4'-diphenylmethane diisocyanate (MDI), and propanediol (PD)/trimethylolethane (TME) as a crosslinking agent were blended, the amount of the crosslinking agent being such that an α-value was 0.95, and the molar ratio of the trifunctional crosslinking agent in the crosslinking agent was 0.15. These materials were reacted to form polyurethane (c).

Polyurethane (d):

100 Parts by mass of caprolactone (PCL) having a molecular weight of 2000, 40 parts by mass of 3,3-dimethylphenyl-4,4-diisocyanate (TODI), and trimethylolpropane (TMP)/3,5-dimethylthio-2,4-toluenediamine (DMTDA) as a crosslinking agent were blended, the amount of the crosslinking agent being such that an α-value was 0.95, and the molar ratio of the trifunctional crosslinking agent in the crosslinking agent was 0.35. These materials were reacted to form polyurethane (d).

Polyurethane (e):

100 Parts by mass of caprolactone (PCL) having a molecular weight of 3000, 30 parts by mass of 3,3-dimethylphenyl-4,4-diisocyanate (TODI), and butanediol (BD)/trimethylolpropane (TMP) as a crosslinking agent were blended, the amount of the crosslinking agent being such that an α-value was 0.95, and the molar ratio of the trifunctional crosslinking agent in the crosslinking agent was 0.35. These materials were reacted to form polyurethane (e).

Polyurethane (f):

100 Parts by mass of caprolactone (PCL) having a molecular weight of 2000, 47 parts by mass of 4,4'-diphenylmethane diisocyanate (MDI), and butanediol (BD)/trimethylolpropane (TMP) as a crosslinking agent were blended, the amount of the crosslinking agent being such that an α-value was 0.95, and the molar ratio of the trifunctional crosslinking agent in the crosslinking agent was 0.30. These materials were reacted to form polyurethane (f).

Polyurethane (g):

100 Parts by mass of caprolactone (PCL) having a molecular weight of 2000, 42 parts by mass of 4,4'-diphenylmethane diisocyanate (MDI), and butanediol (BD)/trimethylolpropane (TMP) as a crosslinking agent were blended, the amount of the crosslinking agent being such that an α-value was 0.95, and the molar ratio of the trifunctional crosslinking agent in the crosslinking agent was 0.33. These materials were reacted to form polyurethane (g).

TEST EXAMPLE 1

Test samples of polyurethanes (a) to (g) were prepared, and the test sample comprising each polyurethane was measured at 23° C. for Young's modulus at 25% elongation according to JIS K6254, tensile strength at 300% elongation (300% modulus), tensile strength, and elongation at breakage according to JIS K6251, tear strength according to JIS K6252, and permanent elongation according to JIS K6262. Impact resilience (Rb) was measured by a Lupke rebound resilience tester according to JIS K6255, and rubber hardness (Hs) was measured according to JIS K6253. The impact resilience and the rubber hardness were also evaluated for their temperature dependence by making measurements at 10° C. to 50° C. The results of the measurements on the respective polyurethanes are shown in Table 1.

TABLE 1

| | Material | | | | | | |
|---|---|---|---|---|---|---|---|
| | a | b | c | d | e | f | g |
| Polyol | 1,9-ND adipate | PTG | 1,9-ND adipate | PCL | PCL | PCL | PCL |
| Molecular weight | 2000 | 1600 | 2000 | 2000 | 3000 | 2000 | 2000 |
| Isocyanate | MDI | MDI | MDI | TODI | TODI | MDI | MDI |

TABLE 1-continued

| | | Material | | | | | | |
|---|---|---|---|---|---|---|---|---|
| | | a | b | c | d | e | f | g |
| Number of parts of isocyanate | | 50 | 60 | 40 | 40 | 30 | 47 | 42 |
| Bifunctional crosslinking agent | | PD/ DMTDA | BD/ DMTDA | PD | DMTDA | BD | BD | BD |
| Trifunctional crosslinking agent | | TME | TMP | TME | TMP | TMP | TMP | TMP |
| α-value | | 0.95 | 0.95 | 0.95 | 0.95 | 0.95 | 0.95 | 0.95 |
| Molar ratio of diamino compound in bifunctional crosslinking agent | | 0.10 | 0.02 | — | 1.00 | — | — | — |
| Molar ratio of trifunctional crosslinking agent in crosslinking agent | | 0.05 | 0.10 | 0.15 | 0.35 | 0.35 | 0.30 | 0.33 |
| Hardness (degree) | K6253 | 83 | 84 | 75 | 88 | 76 | 70 | 67 |
| Impact resilience at 25° C. (%) | K6255 | 32 | 38 | 53 | 43 | 51 | 40 | 50 |
| 300% M (MPa) | K6251 | 32 | 22 | 23 | 21 | 13 | 12 | 11 |
| Tensile strength (MPa) | K6251 | 46 | 35 | 39 | 50 | 47 | 29 | 26 |
| Elongation at breakage (%) | K6251 | 350 | 360 | 360 | 380 | 420 | 360 | 350 |
| Tear strength (kN/m) | K6252 | 103 | 85 | 91 | 67 | 59 | 45 | 40 |
| Young's modulus (MPa) | K6254 | 13.7 | 13.2 | 7.9 | 18.2 | 8.0 | 6.5 | 5.5 |
| Permanent elongation (%) | K6262 | 3.3 | 3.2 | 1.5 | 3.7 | 1.2 | 1.2 | 1.1 |
| Temperature-dependence of impact resilience (%) | 10° C. | 22 | 29 | 31 | 27 | 39 | 18 | 23 |
| | 20° C. | 28 | 35 | 46 | 35 | 47 | 29 | 40 |
| | 30° C. | 38 | 43 | 60 | 45 | 53 | 53 | 58 |
| | 40° C. | 47 | 50 | 70 | 48 | 58 | 72 | 71 |
| | 50° C. | 52 | 53 | 75 | 53 | 59 | 76 | 77 |
| | Δ50-10 | 30 | 24 | 44 | 26 | 20 | 58 | 54 |
| Temperature-dependence of harness (degree) | 10° C. | 84 | 84 | 75 | 89 | 76 | 70 | 68 |
| | 20° C. | 84 | 84 | 75 | 88 | 76 | 70 | 67 |
| | 30° C. | 84 | 84 | 75 | 88 | 76 | 70 | 67 |
| | 40° C. | 83 | 83 | 75 | 88 | 76 | 70 | 67 |
| | 50° C. | 82 | 82 | 74 | 87 | 75 | 70 | 67 |
| | Δ50-10 | 2 | 2 | 1 | 2 | 1 | 0 | 1 |
| tan δ peak temperature (1 Hz) (° C.) | | −8 | −16 | −12 | −19 | −24 | −8 | −11 |

EXAMPLE 1

A back layer and an edge layer were sequentially subjected to centrifugal molding such that the edge layer comprised polyurethane (a) and had a thickness of 0.2 mm and the back layer comprised polyurethane (f) and had a thickness of 1.8 mm, whereby a cleaning blade member was molded. This cleaning blade member was adhered to a metal plate (support member) to form a cleaning blade of Example 1.

EXAMPLE 2

A cleaning blade of Example 2 was formed in the same manner as in Example 1, except that the edge layer comprised polyurethane (b) and had a thickness of 0.5 mm and the back layer had a thickness of 0.5 mm.

COMPARATIVE EXAMPLE 1

A cleaning blade of Comparative Example 1 having a thickness of 2.0 mm was formed by centrifugal molding of polyurethane (a).

COMPARATIVE EXAMPLE 2

A cleaning blade of Comparative Example 2 was formed in the same manner as in Example 1, except that the edge layer had a thickness of 1.0 mm and the back layer comprised polyurethane (d) and had a thickness of 1.0 mm.

COMPARATIVE EXAMPLE 3

A cleaning blade of Comparative Example 3 was formed in the same manner as in Example 1, except that the edge layer comprised polyurethane (c).

COMPARATIVE EXAMPLE 4

A back layer and an edge layer were sequentially subjected to centrifugal molding such that the edge layer comprised polyurethane (d) and had a thickness of 1.0 mm and the back layer comprised polyurethane (g) and had a thickness of 1.0 mm, whereby a cleaning blade of Comparative Example 4 was molded.

COMPARATIVE EXAMPLE 5

A cleaning blade of Comparative Example 5 was formed in the same manner as in Example 1, except that the edge layer comprised polyurethane (e) and had a thickness of 0.5 mm and the back layer had a thickness of 1.5 mm.

TEST EXAMPLE 2

A photoconductor in contact with the cleaning blade of each of the Examples and the Comparative Examples was continuously operated for 60 minutes in idle at a linear velocity of 125 mm/sec in each of an LL environment (10° C. ×35%), an NN environment (23° C.×55%) and an HH environment (30° C.×85%). Then, the wear state of the edge of each cleaning blade was observed and measured using a laser microscope. An average wear sectional area of 0 to 10 $\mu m^2$ was evaluated as ○, that of 11 to 20 $\mu m^2$ was evaluated as Δ, and that of 21 $\mu m^2$ or more was evaluated as ×. Also, the cleaning properties of each cleaning blade were evaluated as follows: ○ when the photoconductor was cleaned satisfactorily, and × when the photoconductor was not cleaned. The measuring conditions are shown below, and the results are shown in Table 2.

Measuring Conditions:

Contact conditions . . . contact angle: 25 deg, contact pressure: 3 gf/cm

Photoconductor . . . OPC (initially coated with lubricant)

Charging conditions . . . potential inside machine: Vd/−750V VI/−50

Measuring conditions for laser microscopy . . . measuring machine: KEYENCE VK-9500, magnification: ×50, mode of measurement: color ultra-deep observation, optical zoom: ×1.0, measuring pitch: 0.10 μm, location of measurement: 5 spots in one cleaning blade (4 spots 20 mm and 80 mm apart from both ends, and central spot)

TEST EXAMPLE 3

The cleaning blade of each of the Examples and the Comparative Examples was mounted on a blade displacement jig such that the amount of contact (the set amount of bite) was 1.7 mm, and the amount of leaning corresponded to an angle of 25 degrees. This blade-jig assembly was allowed to stand for 72 hours in an HH environment (temperature 45° C.×humidity 95%), then withdrawn from the HH environment, and allowed to stand for 6 hours at an ordinary temperature in a deformed state. The cleaning blade was released from the jig, and then allowed to stand for 30 minutes at an ordinary temperature. The amount of edge drooping (the amount of change in the height of the edge) of the cleaning blade was measured with a pick tester using a height gauge.

Figure 2:
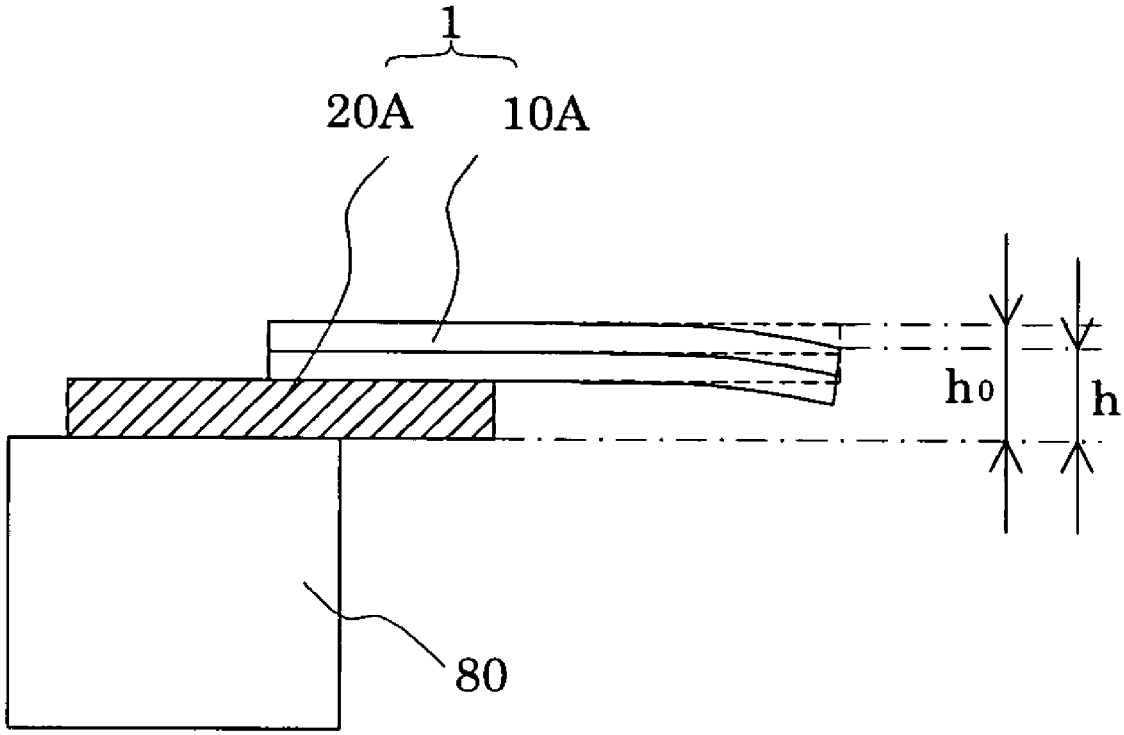
FIG. 2 is a sectional view of essential parts showing a method for measuring the edge height change rate (the amount of edge drooping) of the cleaning blade.

As shown in FIG. 2, a support member 20A of a cleaning blade 1 of each of the Examples and the Comparative Examples was fixed to a fixing jig 80. Then, the height of the edge of a cleaning blade member 10A was measured, and compared with the height of the edge of the cleaning blade member 10A before the test. The rate of change in the height of the edge was calculated from the following equation (4) to determine the edge drooping characteristics of the cleaning blade:

$$\text{Edge height change rate (\%)}=100(h_0-h)/h_0 \quad (4)$$

The edge drooping characteristics of the cleaning blade were evaluated as ○ when the edge height change rate was less than 7%, evaluated as Δ when the edge height change rate was 7% or more and less than 10%, and evaluated as × when the edge height change rate was 10% or more. The results are shown in Table 2.

TABLE 2

| | | | Ex. 1 | Ex. 2 | Comp. Ex. 1 | Comp. Ex. 2 | Comp. Ex. 3 | Comp. Ex. 4 | Comp. Ex. 5 |
|---|---|---|---|---|---|---|---|---|---|
| Edge layer | Material | | a | b | a | a | c | d | e |
| | Young's modulus (MPa) | | 13.7 | 13.2 | 13.7 | 13.7 | 7.9 | 18.2 | 8.0 |
| | Thickness (mm) | | 0.2 | 0.5 | 2.0 | 1.0 | 0.2 | 1.0 | 0.5 |
| | $R_a$: Contribution rate of Young's modulus | | 1.4 | 6.6 | 13.7 | 6.9 | 0.8 | 9.1 | 2.0 |
| Back layer | Material | | f | f | — | d | f | g | f |
| | Young's modulus (MPa) | | 6.5 | 6.5 | — | 18.2 | 6.5 | 5.5 | 6.5 |
| | Thickness (mm) | | 1.8 | 0.5 | 0 | 1.0 | 1.8 | 1.0 | 1.5 |
| | $R_b$: Contribution rate of Young's modulus | | 5.9 | 3.3 | 0 | 9.1 | 5.9 | 2.8 | 4.9 |
| Two layers | Young's modulus (MPa) | | 7.2 | 9.9 | 13.7 | 16.0 | 6.6 | 11.9 | 6.9 |
| | Thickness (mm) | | 2.0 | 1.0 | 2.0 | 2.0 | 2.0 | 2.0 | 2.0 |
| | $R_b/R_a$ | | 4.27 | 0.49 | 0 | 1.33 | 7.41 | 0.30 | 2.44 |
| Actual machine evaluation | LL | Cleaning properties | ○ | ○ | X | X | ○ | ○ | ○ |
| | | Wear resistance | ○ | ○ | ○ | Δ | Δ | Δ | Δ |
| | NN | Cleaning properties | ○ | ○ | ○ | X | X | ○ | ○ |
| | | Wear resistance | ○ | ○ | ○ | Δ | X | X | Δ |
| | HH | Cleaning properties | ○ | ○ | ○ | X | X | Δ | ○ |
| | | Wear resistance | ○ | ○ | ○ | Δ | X | X | X |
| Confirmation of edge drooping characteristics | | | ○ | ○ | X | X | ○ | Δ | ○ |

Summary of Results:

The cleaning blades of Examples 1 and 2 were satisfactory in cleaning characteristics and wear resistance in any environment.

The cleaning blade of Comparative Example 1, which comprised a single layer of the same material as the edge layer of Example 1, required a high contact pressure in order to maintain cleaning characteristics, thereby undergoing marked large edge drooping.

The cleaning blade of Comparative Example 2, which had the same material as the edge layer of Example 1, but had a high Young's modulus in the two layers, scarred the photoconductor, thus resulting in poor cleaning characteristics and unsatisfactory wear resistance. Thus, it was found preferred to select the back layer fulfilling the aforementioned definitions and construct the two-layer cleaning blade.

The cleaning blades of Comparative Examples 3 to 5, in which the impact resilience at 25° C. of the edge layer was 40% or more, were all poor in wear resistance.

The embodiments of the present invention have been described above, but the invention is not limited to these embodiments. It should be understood that the invention can be subject to changes, substitutions or alterations without departing from the spirit and scope of the invention as defined by the appended claims.

What is claimed is:

1. A cleaning blade member for use in a cleaning section for removing toner on a toner-deposited body, the cleaning blade member comprising two layers consisting of:

an edge layer making contact with the toner-deposited body; and a back layer provided on a back side of the edge layer, and wherein the edge layer has a Young's modulus of 8 to 20 MPa and an impact resilience at 25° C. of 20 to 40%, and when the Young's modulus of the edge layer is designated as $E_a$, a Young's modulus of the back layer is designated as $E_b$, a thickness of the edge layer is designated as $T_a$, and a thickness of the back layer is designated as $T_b$, a ratio ($R_b/R_a$) between a contribution rate $R_a$ of the Young's modulus of the edge layer represented by an equation (1) indicated below, and a contribution rate $R_b$ of the Young's modulus of the back layer represented by an equation (2) indicated below is 0.01 to 6.0, and a total Young's modulus ($R_a+R_b$) of the edge layer and the back layer is 7 to 14 MPa:

$$R_a=[T_aE_a/(T_a+T_b)] \quad (1)$$

$$R_b=[T_bE_b/(T_a+T_b)] \quad (2).$$

2. The cleaning blade member according to claim 1, wherein a peak temperature at tan δ (1 Hz) of the edge layer is −20° C. to 5° C.

3. The cleaning blade member according to claim 1, wherein a difference ΔHs (°) (JIS A) between a hardness at 50° C. of the edge layer, $HS_{T50}$ (°) (JIS A), and a hardness at 10° C. of the edge layer, $HS_{T10}$ (°) (JIS A), is 4 or less.

4. The cleaning blade member according to claim 1, wherein a difference ΔRb (%) between an impact resilience at 50° C. of the edge layer, $Rb_{T50}$ (%), and an impact resilience at 10° C. of the edge layer, $Rb_{T10}$ (%), is 30 or less.

5. The cleaning blade member according to claim 1, wherein the edge layer and the back layer are integrally molded by centrifugal molding.

* * * * *